US010987723B2

(12) United States Patent
Zhang et al.

(10) Patent No.: US 10,987,723 B2
(45) Date of Patent: Apr. 27, 2021

(54) PROCESS FOR MANUFACTURING A SHELL MOLD

(71) Applicants: SAFRAN, Paris (FR); SAFRAN AIRCRAFT ENGINES, Paris (FR)

(72) Inventors: Wen Zhang, Moissy-Cramayel (FR); Patrice Henri Claude Ragot, Moissy-Cramayel (FR)

(73) Assignees: SAFRAN, Paris (FR); SAFRAN AIRCRAFT ENGINES, Paris (FR)

( * ) Notice: Subject to any disclaimer, the term of this patent is extended or adjusted under 35 U.S.C. 154(b) by 0 days.

(21) Appl. No.: 16/319,796

(22) PCT Filed: Jul. 21, 2017

(86) PCT No.: PCT/FR2017/052030
§ 371 (c)(1),
(2) Date: Jan. 22, 2019

(87) PCT Pub. No.: WO2018/015701
PCT Pub. Date: Jan. 25, 2018

(65) Prior Publication Data

US 2019/0329317 A1 Oct. 31, 2019

(30) Foreign Application Priority Data

Jul. 22, 2016 (FR) ..... 1657022

(51) Int. Cl.
*B22C 1/16* (2006.01)
*B22C 1/08* (2006.01)
*B22C 9/04* (2006.01)

(52) U.S. Cl.
CPC ..... *B22C 1/165* (2013.01); *B22C 1/08* (2013.01); *B22C 9/04* (2013.01)

(58) Field of Classification Search
CPC ..... B22C 1/165; B22C 1/08; B22C 9/04
See application file for complete search history.

(56) References Cited

U.S. PATENT DOCUMENTS 4,196,769 A 4/1980 Feagin
5,927,379 A 7/1999 Yasrebi et al.
6,814,131 B2 11/2004 Vandermeer
(Continued)

FOREIGN PATENT DOCUMENTS

EP 0479672 A1 4/1992
EP 2153919 A1 2/2010
(Continued)

OTHER PUBLICATIONS

International Patent Application No. PCT/FR2017/052030, International Search Report and Written Opinion dated Nov. 29, 2017, 14 pgs. (relevance in citations and English translation).
(Continued)

*Primary Examiner* — Kevin P Kerns
*Assistant Examiner* — Steven S Ha
(74) *Attorney, Agent, or Firm* — Lathrop GPM LLP

(57) ABSTRACT

The invention concerns a method of manufacturing a shell mould (1) with several layers (2, 3, 4, 5), including at least one contact layer (2), from a model (6) of wax or other similar material of a part to be manufactured, the method comprising a step of dipping the model (6) into a contact slip forming the contact layer (2) and comprising an inorganic or organic binder and a powder, wherein the powder is a mullite-zirconia composite.

25 Claims, 3 Drawing Sheets

(56) References Cited

U.S. PATENT DOCUMENTS

| | | | |
|---|---|---|---|
| 6,951,239 | B1 | 10/2005 | Snyder et al. |
| 7,461,684 | B2 | 12/2008 | Liu et al. |
| 9,352,385 | B2 | 5/2016 | Lanver et al. |

FOREIGN PATENT DOCUMENTS

| | | | |
|---|---|---|---|
| GB | 2017118 | | 10/1979 |
| JP | H0615404 | A | 1/1994 |
| RU | 2 299 111 | C2 | 5/2007 |
| RU | 2 311 984 | C2 | 12/2007 |
| RU | 2 466 821 | | 11/2012 |

OTHER PUBLICATIONS

Chinese Patent Application No. 2017800455973; First Office Action dated Mar. 23, 2020; 6 pages.

PROCESS FOR MANUFACTURING A SHELL MOLD

CROSS-REFERENCE TO RELATED APPLICATIONS

This application is a 35 U.S.C. § 371 filing of International Application No. PCT/FR2017/052030, filed Jul. 21, 2017, which claims the benefit of priority to French Patent Application No. 1657022, filed Jul. 22, 2016, each of which is incorporated herein by reference in its entirety.

This invention concerns the manufacture of a foundry mould in a process known as "lost-wax", for the manufacture of precision metal parts. This type of mould is also called a shell mould.

The production of "lost wax" moulds is well known and widely used, particularly for the manufacture of precision parts with complex geometries or precision parts in very small or even unique series.

To make a lost wax mould, a model of the part to be produced is first made of wax or of a removable material that can be easily melted or removed from the manufactured mould.

The model is successively tempered, sandblasted and/or coated with reinforcing medium and dried. The quenching operation is carried out in one or more slip(s). The sandblasting operation, also called stucco, consists in reinforcing the deposit constituted by the layer of slip deposited on the model during quenching. After each quenching and sandblasting and/or coating operation, the water is removed from the different layers. Then, the model is eliminated, for example during a passage in an autoclave (pressure and temperature treatment). Lastly, the mould undergoes a heat treatment in order to give it the necessary characteristics for casting the metal.

For the manufacture of precision metal parts, a mould must be stable when casting molten metal. Stable means that the molten metal must not cause the mould material to react in such a way that it deforms.

In order for the mould to have a perfect surface finish for the production of a part, it is important that the composition of the first layer in contact with the model, commonly referred to as the contact layer, is chemically compatible and accurately matches the profile of the model. This contact layer is the result of soaking the model in a contact slip. The contact layer must be homogeneous, stable, fluid, dense, non-reactive with the molten metal of the precision part to be manufactured and compatible with the following layers of the mould. In addition, the expansion coefficients of the contact layer and the subsequent layers constituting the mould must be compatible in order to avoid any damage caused by a difference in thermal expansion of the layers.

The use of different slip materials that include either alumina, zircon, or electrofused silica, is known in the art. Each one of these compounds has at least one particular disadvantage. For example, alumina is not compatible with certain alloys that constitute the precision metal parts to be produced, electrofused silica lacks refractoriness, and zircon, in addition to being radioactive, loses stability as the temperature of the molten alloy increases.

The invention more particularly aims at providing a simple, efficient and cost-effective solution to these problems.

To this end, the invention proposes a method of manufacturing a multi-layer shell mould, including at least one contact layer, from a model of the part to be manufactured of wax or other similar material, the method comprising a step of dipping the model into a contact slip forming the contact layer and comprising a binder and a powder, the powder comprising a mullite-zirconia composite.

The use of a mullite-zirconia composite powder limits the chemical interactions between the shell mould and the metal alloy introduced by casting into the shell mould. The above-mentioned composite is preferably mainly or almost exclusively composed of mullite and zirconia. Of course, it is understood that it may include negligible amounts of impurities. These impurities may include calcium or sodium. According to a characteristic of the invention, the binder may be inorganic or organic or a mixture of organic and inorganic compounds.

Mullite-zirconia composite powder makes it possible to produce a contact slip with good rheological stability, good chemical inertia towards the molten alloy, and which allows controlled manufacturing.

It should be remembered that a composite is a material composed of several elementary components whose combination gives to the whole properties that none of the components taken separately possess.

Mullite-zirconia composite powder can be obtained by chemical synthesis using a mullite precursor such as alumina and/or silica and a zirconia precursor such as zirconia. The grains of the powder are then formed from an aggregate of mullite and zirconia.

Preferably, the grains of the mullite-zirconia composite powder have an average size between 5 and 20 μm and a size distribution ranging from a submicron size to a size of 100 μm.

According to another characteristic, the contact layer can have a thickness of 1 mm or less. It is desirable to limit the thickness of the contact layer to avoid mechanically weakening the shell mould due to the presence of zirconia.

To obtain a good quality contact slip, the zirconia content in the powder is between 5% and 90% w/w and, preferably between 10% and 50% w/w and even more preferably between 30% and 50% w/w.

Advantageously, the binder is colloidal silica.

To promote the wetting of the contact layer on the surface of the model, the contact slip also includes at least one wetting agent and/or at least one anti-foaming agent.

To make a resistant mould for the manufacture of a precision part, the process includes, following soaking of the model in the contact slip, steps in which:

- the model is sandblasted,
- the sandblasted model is dried,
- the sandblasted and dried model is dipped in a second slip which can preferably be free of zirconia in order to give it improved mechanical resistance,
- the model dipped in the second slip is coated with a reinforcing material,
- the model coated with the reinforcing material is dried, and
- a heat treatment is carried out on the model coated with the reinforcing material and dried.

Advantageously, the steps of soaking in the second slip, coating with the reinforcing material and drying the model coated with the reinforcing material and dried are repeated.

The succession of steps in this process and, if necessary, the repetition of certain steps, results in a good quality mould that will resist the manufacture of a precision part and offer a good external surface finish to the manufactured precision part.

This process, prior to soaking the model in the contact slip, includes a phase of preparing the contact slip including the sub-steps wherein:

the binder is introduced into the container, the mullite-zirconia composite powder is added to the mixer, the mixture of mineral colloidal binder and composite powder is allowed to stabilize.

Advantageously, the contact slip manufacturing phase also includes a sub-step of adding the anti-foam and/or wetting agent.

In addition, the invention also concerns the use of a mould according to the method described above for the manufacture of a cast and solidified turbomachine part.

The invention will be better understood and other details, characteristics and advantages of the invention will become readily apparent upon reading the following description, given by way of a non limiting example with reference to the appended drawings, wherein:

FIG. 1 shows a flowchart showing the steps involved in manufacturing a lost-wax mould 1 for the manufacture of precision parts. The name "shell mould" is also used to refer to this type of mould, however, in the following description, we will use the simplified term mould 1.

Figure 2:
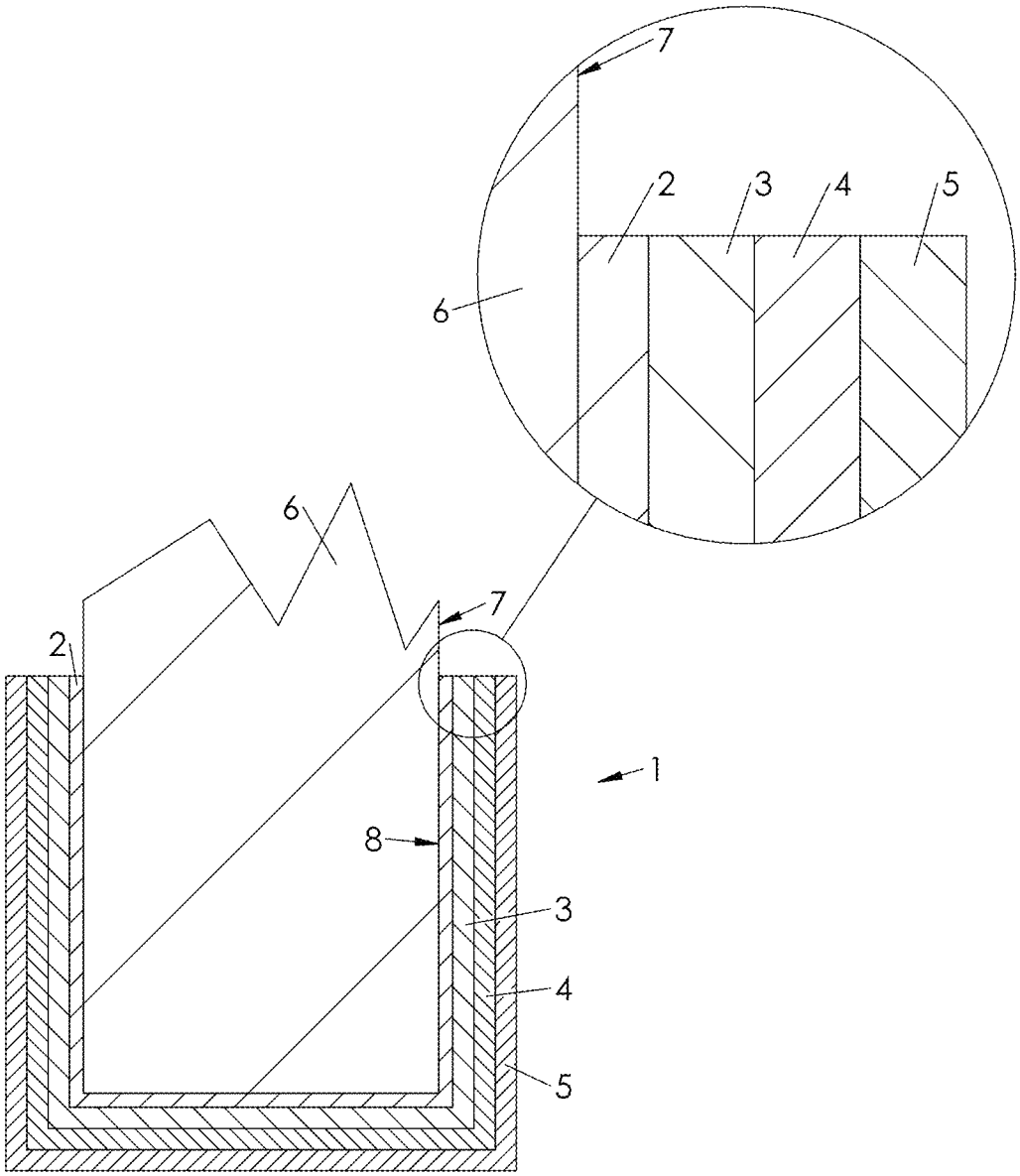
FIG. 2 is a schematic cross-sectional view of a casting mould prior to a step of heat treatment.

Mould 1, shown in cross-section in FIG. 2, comprises a plurality of layers 2, 3, 4, 5, superimposed on each other and covering a model 6 made of wax or a similar material, i.e. a material with similar characteristics and easily removable.

The process of making mould 1 includes steps 100 to 700, which will now be described.

In a first step 100, model 6 of the precision part to be manufactured is made in wax.

To ensure the production of a perfect precision part, model 6 is manufactured to the exact dimensions of the precision part and includes a high-quality external surface finish 7. Thus, only a few slight irregularities may be visible or detectable on the outer surface 7 of the model 6 so that the final precision part will only need one finishing pass (i.e. a machining operation) to grind the outer surface of the precision part thus obtained.

Advantageously, model 6 will have such a surface finish that a finishing pass will not be necessary and the precision part can be used directly at the exit of the mould.

For example, the precision part to be manufactured will be a turbomachine blade that must have an exterior surface free of roughness in order to:

limit the risk of blade breakage when subjected to high centrifugal force in use, or limit the disturbances of an air flow flowing on the outer surface of the blade.

In a second step 200, the model is dipped in a contact slip to form, around model 6, a contact layer 2 which can have a thickness less than or equal to 1 mm.

Contact layer 2 has an essential role in the use of mould 1 since it will give its outer surface to the produced precision part. It is therefore necessary that the contact slip is dense and resistant at the same time, and that its viscosity and covering power are controlled.

Viscosity and density are necessary so that during soaking, the contact slip perfectly matches the wax model 6, and more precisely the outer surface 7 of the wax model 6 without creating, between the contact slip and the outer surface 7 of the model 6, air bubbles that would form, on an inner surface 8 of the mould 1, a cavity conducive to the creation of an asperity on the outer surface of the precision part.

On the other hand, the resistance of the contact slip will be necessary, so that the contact layer 2 does not deform during the manufacture of the precision part.

To meet this dual criterion of viscosity and strength, the contact slip is composed of an inorganic and/or organic binder and a powder, in this case a mullite-zirconia composite.

Preferably, the binder is an inorganic colloidal binder such as colloidal silica in a weight percentage between 10% and 40% and, preferably, between 20% and 30%.

As examples, the inorganic binder may be sodium silicate or ethyl silicate and the organic binder includes water.

The powder contains, in weight percent, a zirconia content of between 5% and 90% and, preferably, between 10% and 50% and even more preferably between 30% and 50%.

According to a preferred embodiment, the mass distribution of the elements composing the contact slip is as follows:

binder (colloidal silica): 29.8%;

composite powder (mullite-zirconia): 70.0%;

wetting agent, anti-foaming agent and other additives: 0.2%.

The mass distribution is given here as an example, it being understood that a variation in the mass distribution between 0.1% and 10% is possible.

For example, the other additives that can be added may be a bactericidal agent to limit bacteria and increase the stability of the slip, or other organic binders to ensure a uniform and resistant deposit of the contact layer 2 on the wax model 6.

Advantageously, the contact slip also includes a wetting agent and an anti-foaming agent.

The production of the contact slip can be carried out as follows:

the mineral colloidal binder and wetting agent are introduced and mixed in a container, in this case a mixer, the mullite-zirconia composite powder is then added to the mixer, the anti-foaming agent is added, the mixer is kept running for between 1 hour and 48 hours, preferably for 24 hours, the resulting mixture is transferred to a container for soaking the model, such as a soaking tank, and the mixture is allowed to stabilize for a period of between 24 hours and 48 hours, and preferably for a period of 24 hours.

Following these steps, the mixture in the tempering tank is then the contact slip.

The composition of the contact slip has many advantages over the slip of the prior art, including better durability, good chemical stability, shorter manufacturing time, non-radioactive formulation and improved mould quality.

For example, compared to the slip of the prior art, the contact slip according to the invention offers:

a production time at least halved, a higher density of at least 16%, a viscosity at least 60% lower at the end of manufacture and about 50% lower 30 days after the end of manufacture, and better coverage of the wax model 6, especially in its complex shapes, such as recesses or grooves.

In a third step 300, model 6, dipped in the contact slip, is sanded and then dried. Sandblasting is carried out in a gentle manner with a powder that will not affect contact layer 2 and in particular the condition of the inner surface 8 of mould 1.

Sandblasting makes it possible to reinforce contact layer 2 and facilitates the attachment of a second layer of mould 1.

In a fourth step 400, model 6 coated by the sanded and dried contact layer 2 is tempered in a second slip, which may be of the same composition as the contact slip or of a different composition.

In a fifth step 500, the model, which comes out of the second slip, is sanded and then dried.

At the end of step 500, a model 6 is obtained on which the contact layer 2 and a first reinforcement layer 3 are superimposed.

Figure 1:
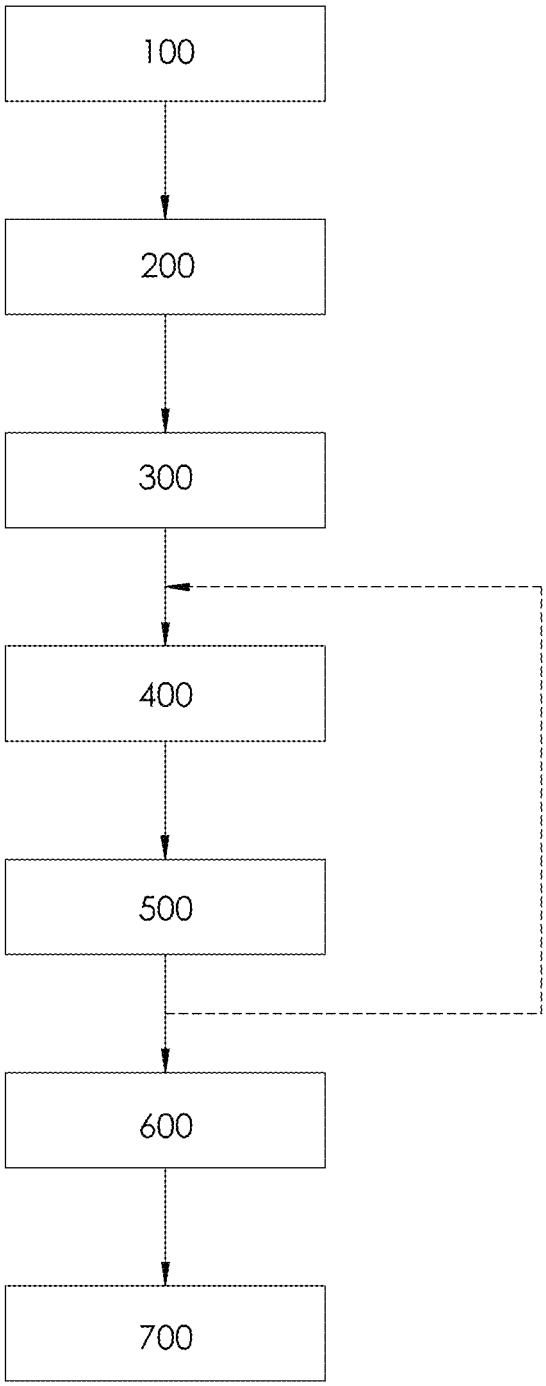
FIG. 1 is a flowchart showing the manufacturing steps of a lost wax casting mould according to the invention.

As shown on the flowchart in FIG. 1 by the dotted arrow, steps 400 and 500 can be repeated depending on the thickness to be given to mould 1.

In the example of mould 1 shown in FIG. 2, a second reinforcement layer 4 and a third reinforcement layer 5 were superimposed on the first reinforcement layer.

However, this example of mould 1 is by no means restrictive and a higher or lower number of reinforcement layers 3 could be provided.

In a sixth step 600, the wax model 6 is melted so that only mould 1 remains.

Finally, in a seventh (and last) step 700, mould 1, comprising an adequate number of reinforcement layers (here three reinforcement layers 3, 4, 5) undergoes a heat treatment, in this case a firing in an oven, in order to solidify mould 1.

However, generally, the removal of the wax model 6 (also called the waxing step) is performed before the heat treatment of mould 1. It is also possible that the wax model 6 will be removed in heat treatment step 700, the temperature to consolidate mould 1 being sufficient to melt the wax from model 6, steps 600 and 700 then being combined in a single step.

When mould 1 is finished, a material, for example a metal alloy for the manufacture of blades, can be cast into mould 1, against the inner surface 8. After cooling, this cast material then forms the precision part to be manufactured.

To remove the precision part from mould 1, mould 1 can be removed mechanically (mould 1 breaking) or chemically (mould 1 dissolution), or by a combination of both methods.

Another advantage of choosing a mullite-zirconia composite powder for the contact slip is that contact layer 2 has a low (or no) risk of chemical reaction with a wide variety of materials that can be cast to form the precision part.

In addition, the mullite-zirconia composite ensures a good ease of use of the slip and allows the wax models 6 with complex geometries to be covered and in particular to be accommodated in grooves and other poorly accessible cavities so that all the details of the wax models 6 are reproduced on the contact layer 2.

Finally, the mullite-zirconia composite offers the advantage of not being radioactive, and can therefore be handled without specific equipment.

Figure 3:
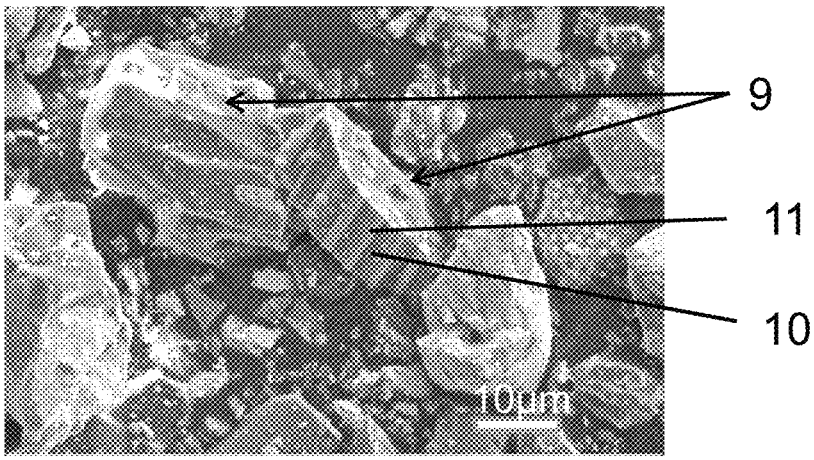
FIGS. 3 and 4 are images obtained by scanning electron microscopy of the grains of two different mullite-zirconia composites which can both be used in the process according to the invention.
Figure 4:
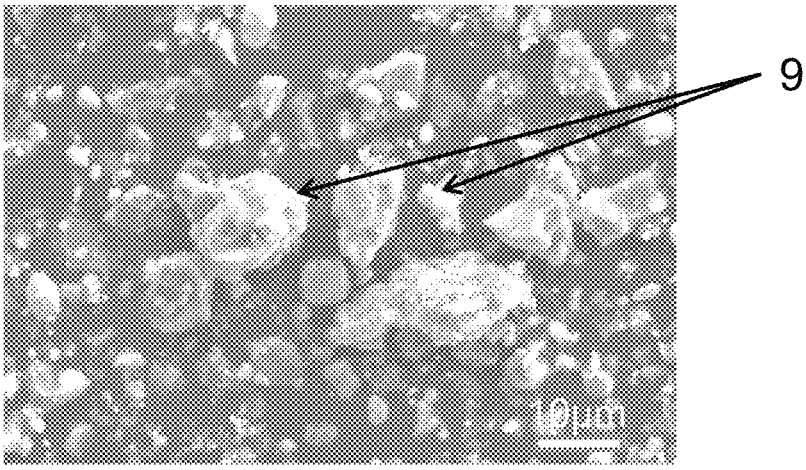

Reference is now made to FIGS. 3 and 4, which represent two images obtained by scanning electron microscopy of the grains of two different mullite-zirconia composites, both of which can be used in the process according to the invention. Mullite-zirconia composite can be obtained by fusion synthesis (FIG. 3) or by solid state reactive sintering synthesis (FIG. 4) followed in both cases by solidification by cooling. The resulting mullite-zirconia composite blocks are then micronized or ultra-finely ground.

In the image of FIG. 3, several particles 9 can be distinguished from the mullite-zirconia composite powder, with mullite being indicated by reference number 10 and zirconia by reference number 11. In the image of FIG. 4, mullite and zirconia are not distinguished within a particle 9 due to a more homogeneous distribution of mullite and zirconia within a grain of the mullite-zirconia composite powder.

Figure 5:
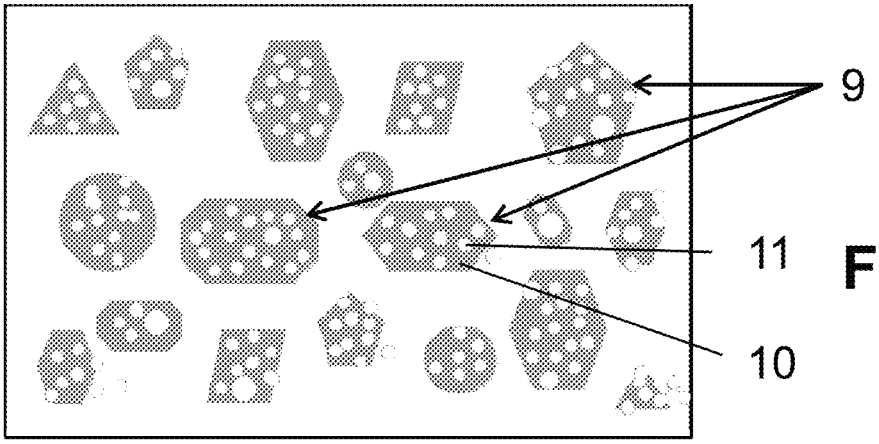
FIG. 5 illustrates different grains of a mullite-zirconia composite powder.

FIG. 5 is a schematic illustration of several particles of a mullite-zirconia composite powder showing the diversity of particle shapes. Preferably, the particles of the mullite-zirconia composite powder have an average size between 5 and 20 μm and a size distribution ranging from a submicron size to a size of 100 μm.

The invention claimed is:

1. A method for manufacturing a shell mould with several layers including at least one contact layer, from a model of a part to be manufactured, the method comprising a step of dipping the model into a contact slip forming said at least one contact layer and comprising a binder and a powder, characterized in that the powder comprises a mullite-zirconia composite.

2. A process according to claim 1, wherein the zirconia content in the powder is between 5% and 90% by weight.

3. Process according to the claim 2, in which the zirconia content in the powder is between 10% and 50% by weight.

4. A process according to claim 2, wherein the zirconia content in the powder is between 30% and 50% by weight.

5. A process according to claim 2, wherein particles of the mullite-zirconia composite powder have an average size between 5 and 20 μm.

6. A process according to claim 2, wherein said at least one contact layer has a thickness less than or equal to 1 mm.

7. A process according to claim 2, wherein the binder is colloidal silica.

8. A process according to claim 2, wherein the contact slip further comprises at least one wetting agent and an antifoaming agent.

9. A process according to claim 2, wherein, prior to the step of dipping the model in the contact slip, a phase of making the contact slip comprises the steps of:

introducing the binder into a container;

adding the mullite-zirconia composite powder to the container; and allowing the mixture of the binder and the powder to stabilize.

10. A process according to claim 9, wherein the container is a mixer.

11. A process according to claim 1, wherein particles of the mullite-zirconia composite powder have an average size between 5 and 20 μm.

12. A process according to claim 1, wherein said at least one contact layer has a thickness less than or equal to 1 mm.

13. A process according to claim 1, wherein the binder is colloidal silica.

14. A process according to claim 13, wherein, prior to the step of dipping the model in the contact slip, a phase of making the contact slip comprises the steps of:

introducing the binder into a container;

adding the mullite-zirconia composite powder to the container; and allowing the mixture of the binder and powder to stabilize.

15. A process according to claim 14, wherein the phase of making the contact slip further comprises a step of adding one or both of an antifoaming agent and a wetting agent.

16. A process according to claim 14, wherein the container is a mixer.

17. A process according to claim 1, wherein the contact slip further comprises at least one of a wetting agent and an antifoaming agent.

18. A process according to claim 1, further comprising, following the step of dipping the model into the contact slip, the steps of:

sandblasting the model;

drying the sandblasted model;

dipping the sandblasted and dried model into a second slip;

coating the model dipped in the second slip with a reinforcing material;

drying the model coated with the reinforcing material; and subjecting the model coated with the reinforcing material and dried to heat treatment.

19. A process according to claim 18, in which the steps of dipping the sandblasted and dried model into the second slip, coating the model dipped in the second slip with the reinforcing material, and drying the model coated with the reinforcing material are repeated.

20. A process according to claim 18, wherein the second slip is without zirconia.

21. A process according to claim 1, wherein, prior to the step of dipping the model in the contact slip, a phase of making the contact slip comprises the steps of:

introducing the binder into a container;

adding the mullite-zirconia composite powder to the container; and allowing the mixture of the binder and the powder to stabilize.

22. A process according to claim 21, wherein the container is a mixer.

23. A process according to claim 1, wherein said model is formed of wax.

24. A mould for manufacture of a cast and solidified turbomachine part, the mould being made by dipping a model into a contact slip comprising a binder and a mullite-zirconia composite powder to form at least one contact layer.

25. A mould of claim 24, wherein the zirconia content in the powder is between 5% and 90% by weight.

* * * * *